US005355789A

United States Patent [19]

Suzuki et al.

[11] Patent Number: 5,355,789

[45] Date of Patent: Oct. 18, 1994

[54] REFUSE COMPRESSION APPARATUS

[75] Inventors: Jiro Suzuki, Nara; Takeshi Tomizawa, Ikoma; Tatsuo Fujita, Osaka; Kunihiro Ukai, Ikoma, all of Japan

[73] Assignee: Matsushita Electric Industrial Co., Ltd., Osaka, Japan

[21] Appl. No.: 916,258

[22] Filed: Jul. 21, 1992

[30] Foreign Application Priority Data

| | | | |
|---|---|---|---|
| Jul. 23, 1991 | [JP] | Japan | 3-182249 |
| Sep. 30, 1991 | [JP] | Japan | 3-250952 |
| Sep. 30, 1991 | [JP] | Japan | 3-250955 |
| Oct. 15, 1991 | [JP] | Japan | 3-265928 |
| Oct. 15, 1991 | [JP] | Japan | 3-265930 |

[51] Int. Cl.[5] ..... B30B 15/34; B30B 5/02

[52] U.S. Cl. ..... 100/92; 100/211; 100/226; 100/240; 100/250; 100/269 A; 100/915; 220/8; 220/908

[58] Field of Search ..... 100/90, 93 P, 92, 211, 100/226, 228, 229 A, 227, 240, 245, 250, 269 A, 915; 220/8, 402, 908

[56] References Cited

U.S. PATENT DOCUMENTS

| | | | |
|---|---|---|---|
| 280,325 | 6/1883 | Orton | 100/245 X |
| 1,312,575 | 8/1919 | Pritchard | 220/8 |
| 1,372,190 | 3/1921 | Randall et al. | 100/90 |
| 3,329,298 | 7/1967 | Demas | 220/8 |
| 3,683,795 | 8/1972 | Harris | 100/245 X |
| 3,688,689 | 9/1972 | Fierle et al. | 100/269 A X |
| 3,717,089 | 2/1973 | Oles et al. | 100/229 A X |
| 3,736,863 | 6/1973 | Brucker | 100/269 A X |
| 3,899,967 | 8/1975 | Powers | 100/211 X |
| 4,748,905 | 6/1988 | Langdon | 100/90 |
| 4,860,958 | 8/1989 | Yerman | 100/93 P X |
| 5,083,509 | 1/1992 | Hansen et al. | 100/90 X |
| 5,263,841 | 11/1993 | de Soet | 100/92 X |

FOREIGN PATENT DOCUMENTS

| | | | |
|---|---|---|---|
| 1173837 | 7/1964 | Fed. Rep. of Germany | 100/218 |
| 4023843 | 2/1992 | Fed. Rep. of Germany | 220/8 |
| 55-94797 | 7/1980 | Japan | 100/90 |
| 1-181603 | 7/1989 | Japan | 100/92 |
| 1-252401 | 10/1989 | Japan | 220/908 |
| 88/09264 | 12/1988 | PCT Int'l Appl. . | |

*Primary Examiner*—Stephen F. Gerrity

*Attorney, Agent, or Firm*—Wenderoth, Lind & Ponack

[57] ABSTRACT

A refuse compression apparatus for reducing the volume of a thermal elastic refuse includes a telescopic refuse container which is covered by a bag and is housed in a cylindrical housing and suspended on the top of the cylindrical housing. A top cover box is coupled with the telescopic refuse container and the cylindrical housing so that the bag divides the inner space of the cylindrical housing into a free space inside the bag and an airtight space outside the bag. An air pump provided to connect the airtight space and the outside of the cylindrical housing operates to pressurize the airtight space and cause the bag to press the telescopic refuse container upwardly. Thus, the refuse placed in the telescopic refuse container is pressed against the lower surface of the top cover box and is compressed.

21 Claims, 7 Drawing Sheets

REFUSE COMPRESSION APPARATUS

BACKGROUND OF THE INVENTION

1. Field of the Invention

The present invention relates to a refuse compression apparatus for primarily household use for the purpose of reducing the volume of refuse with a low moisture content, such as paper and plastics refuse generated in the home, stores, and offices, by means of a simple operation using a device of simple construction.

2. Description of the Prior Art

For example, if cans, bottles, newspapers, and other recyclable refuse is removed from common household refuse, the remaining refuse can be classified in three categories: kitchen garbage such as food wastes, plastic packaging such as for food packaging, and miscellaneous non-recyclable paper. Kitchen garbage represents a very small percent of this total waste volume, and plastics and paper refuse are generally considered to account for over 90% of the total volume.

These wastes are typically processed centrally, by collecting refuse by sending garbage collection trucks around on a predetermined schedule to collect the trash, and then hauling it to a central processing facility for incineration or burial. It follows that each household must store this refuse in the home until the scheduled collection date, and must deliver the refuse to the scheduled pick-up place by the scheduled time.

Various devices and methods have been proposed to enable on-site (or nearby) processing of these wastes as a means of eliminating the inconveniences of following a fixed schedule. Once such method is the garbage disposal machine, which grinds kitchen wastes into particles small enough to wash down the drain with a flow of water. Other methods include thermal combustion methods using a heater, freezing methods to prevent unpleasant odors, and microwave heating combustion methods. Each of these methods is intended for raw kitchen garbage, however, and cannot be easily adapted for reducing the volume of plastics and paper refuse from the home.

In addition, individual garbage disposal machines used in the home mechanically reduce wastes to be flushed down the drain. This greatly increases the solid and organic waste load in household waste water, increasing the pollution of rivers and lakes with all incumbent social side effects. The tendency today, therefore, is to prohibit the use of such garbage disposal machines around the world.

As a result, the most common method of processing garbage is to transfer it to the final waste processing plant, whether incineration plant, landfill, or other, by garbage collection truck. The waste transportation efficiency of these trucks is increased by compressing the trash in the truck as it is collected, but plastic wastes, including packaging and containers, are voluminous, increasing transportation costs and greatly increasing the necessary landfill area. While demand for recycling plastics has become strong in recent years, recycling costs must be reduced.

Various methods have been introduced for reducing the total volume of plastic wastes at the point of use as one means of reducing the collection cost, one of the biggest parts of the total recycling cost. These methods include both cutting and compression methods. Unfortunately, while both methods are fast, cutting results in minimal volume reduction for wastes other than containers, and available compression methods do not significantly reduce the volume and allow the compressed refuse to expand again unless it is first tied. Methods of waste reduction by heating are therefore more promising than cutting and simple compression because the total volume reduction rate is greatest, particularly with such plastics as polystyrene foam, and the potential economic benefits are therefore also greatest.

In these heating method refuse compression apparatuses, however, heat transfer to the center of polystyrene foam blocks and polyethylene plastics such as those used in trash bags is poor. These wastes must therefore be heated for a long period of time before all of the plastic is softened. Furthermore, if the heating temperature is raised to speed the softening process but is raised too much, the plastic wastes will begin to smoke, giving off foul odors, chloride compounds, and potentially toxic or harmful gases. High speed processing is therefore difficult, and yet low temperature processing results in the entire processing machine becoming soiled and difficult to clean.

SUMMARY OF THE INVENTION

The object of the present invention is therefore to provide a refuse compression device which solves these problems.

The present invention has been developed with a view to substantially solving the above described disadvantages and has for its essential object to provide an improved refuse compression device.

In order to achieve the aforementioned objective, a refuse compression apparatus for reducing the volume of refuse, comprises a cylindrical housing having an opening at one end thereof with an opening edge formed therearound; a bag suspended inside the cylindrical housing with the open end thereof held at the opening edge, the bag dividing the inside space of the cylindrical housing into a first space inside the bag and a second space outside the bag; a volume changeable container having an outer rim for receiving refuse therein, the expandable container being suspended inside the bag with the outer rim held at the opening edge; a top cover means for closing the opening to seal the opening of the cylindrical housing, the open end of the bag, and the outer rim of volume changeable container; and a pressure increasing means for increasing the air pressure inside the second space.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

First Embodiment

Figure 1:
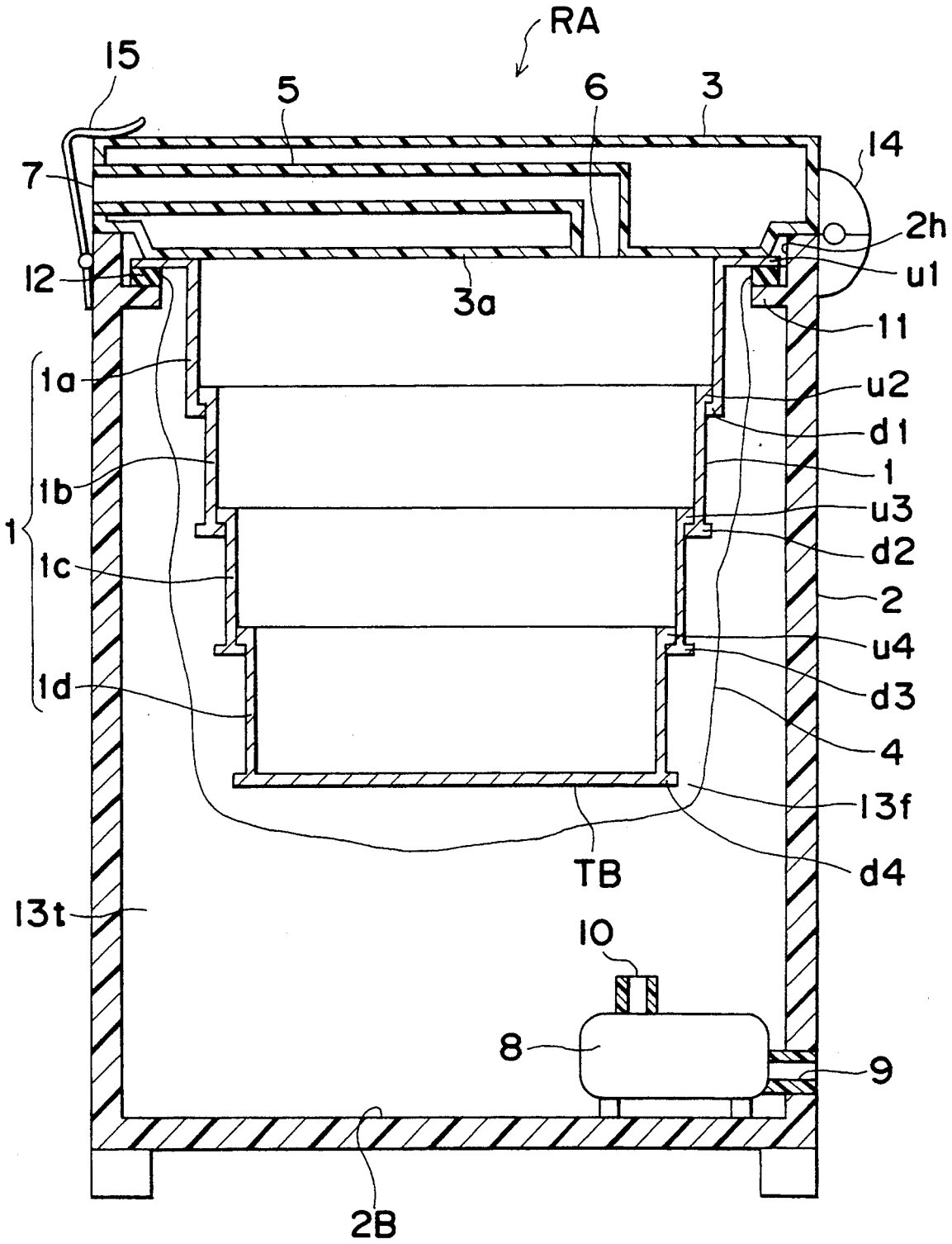
FIG. 1 is a cross sectional view of a refuse compression apparatus according to a first embodiment of the present invention.

Referring to FIG. 1, a refuse compression apparatus according to a first embodiment of the present invention is shown. The refuse compression apparatus RA includes a main housing 2 formed in a generally elongated cylindrical box-like configuration having a circumferential side wall and a bottom plate 2*b*. The end of the housing 2 opposing the bottom plate 2*b* is opened at 2*h*. The refuse compression apparatus RA further includes a lid 3 also formed in a flat cylindrical box-like configuration having a diameter large enough to cover the opening 2*h* of the main housing 2. On one of the flat sides of the lid 3, a circular tier 3*a* having a diameter slightly smaller than that of the opening 2*h* is provided so as to fit in the opening 2*h*. An air exhaust pass 5 is formed in the lid 3 such that one end of the passage 5 opens at the circular tier 3*a* to form an exhaust air inlet 6 and the other end opens at the side surface of the lid 3 to form an exhaust outlet 7.

A hinge 14 and a clamp 15 are provided on the circumferential side walls of the main housing 2 and lid 3, respectively, so as to oppose each other so that the lid 3 can swing with respect to the hinge 14 to close or open the opening 2*h* and can be firmly held at the closed position by the clamp 15.

On the inside surface of the main housing 2, a circular base 11 projecting radially inside by a predetermined length extends therearound to form an inside rim in a position substantially parallel and proximal to the opening 2*h*.

A ring packing 12 is place on the upper surface of the circular base 11. A bag 4 made from a soft plastic material, or any other soft material such as rubber, is integrally connected with the ring packing 12 at the inside surface thereof, as shown.

A telescopic refuse container 1 is provided inside the bag 4. The telescopic container 1 includes top, first middle, second middle, and bottom sub-containers 1*a*, 1*b*, 1*c*, and 1*d* which are formed in tube-like configurations having rimmed portions at both ends. The top sub-container 1*a* has a diameter larger than those of the other sub-containers 1*b*, 1*c*, and 1*d*, but smaller than that of the opening 2*h*. The upper sub-container la has a first upper flange u1 which extends radially outward and seats on the ring packing 12. The upper sub-container la also has a first lower flange d1 which extends radially inside by a small amount.

Inside the top sub-container 1*a*, the first middle sub-container is 1*b* is placed and has a second upper flange u2 radially extending outward by a predetermined length almost the same as that of the first lower flange dl and a second lower flange d2 extending inwardly and outwardly in a radial direction by a small amount to form a second lower flange d2.

Similarly, inside the first and second middle sub-containers 1*b* and 1*c*, the second middle sub-container 1*c* having a third upper and a third lower flange u3 and d3 and the bottom sub-container 1*d* having a fourth upper and a fourth lower flange u4 and d4 are placed, respectively. The bottom sub-container d4 has a flat bottom TB integrally connected to the fourth lower flange d4 to completely cover the opening thereat.

These sub-containers 1*a*, 1*b*, 1*c*, and 1*d* are joined with each other such that the first, second, and third lower flanges d1, d2, and d3 engage with the second, third, and fourth upper flanges u2, u3, and u4, respectively, in a telescopic manner. Thus, the telescopic refuse container 1 can vary in internal volume and is housed within the main housing 2 such that the top sub-container 1*a* rests on the circular base 11 with the ring packing 12 placed between the first upper flange ul and the circular base il to create an airtight seal. Since the telescopic refuse container 1 surrounded by the bag 4 is pressed against the outer circumference of the circular tier 3*a* when the lid 3 is held at the closed position by the clamp 15, a space inside the main housing 2 is divided into two portions: an airtight space 13*t* confined by the bag 4 and the main housing 2 in an airtight manner; and a free space 13*f* confined by the bag 4 and the lid 3.

Inside the main housing 2, an air pump 8 is placed on the bottom plate 2*b* with an intake port 9 opening through the side wall of the main housing 2 and an outlet port 10 opening into the airtight space 13*t*. A compression mechanism is thus formed by the telescopic refuse container 1, airtight space 13*t* formed within the main housing 2, bag 4, circular base 11, and ring packing 12, and the air pressure generated by the air pump 8. It is to be noted that the air pump 8 can be placed outside the housing, or in a compartment provided separately from the airtight space 13*t*.

In operation, plastic, paper, and similar refuse is placed in the telescopic refuse container 1 and the cover 3 is closed and held in position firmly. The air pump 8 is then operated to pump air into the airtight space 13*t* through the intake port 9 and the outlet port 10, causing the internal pressure of the airtight space 13*t* to increase while the internal pressure of the free space 13*f* remains. This increased internal pressure of the airtight space 13*t* acts on the bag 4 so that the bag 4 presses each of sub-containers 1*a*, 1*b*, 1*c*, and 1*d* to slide upwardly.

First, the bag 4 pushes up the flat bottom TB of the bottom sub-container 1*d* until the fourth lower flange d4 contacts with the third lower flange d3 of the second middle sub-container 1*c*. As the pressure rises continuously, the bag 4 further moves to the second middle sub-container 1*c* such that the fourth lower flange d4 pushes up the third lower flange d3. Thus, the sub-containers 1*d*, 1*c*, 1*b*, and 1*a* slide up toward the lid 3 subsequently and the refuse container 1 is reduced in volume. The refuse placed in the refuse container 1 is therefore compressed between the bottom plate TB and the tier 3*a*, resulting in the volume reduction of the refuse. As the telescopic refuse container 1 shrinks in a telescopic motion, the air inside the free space 13*f* passes through the exhaust inlet 6 and passage 5 and is vented outside through the exhaust outlet 7.

The volume of refuse can thus be reduced with an extremely simple operation. If a low compression pressure setting is used, a high pressure fan can be used in place of the air pump. If the compression pressure is set at 0.2 kg/cm$^2$, and the area of the bottom TB of the refuse container ld is approximately 300 cm$^2$, a highly compressive force of approximately 60 kg is obtained. The main housing 2, lid 3, and refuse container 1 are constructed with sufficient mechanical strength to withstand the forces applied to the respective parts thereof.

The pressure setting can also be set higher, and a compressive force approximately 20 times greater can be easily generated using an air pump. Even higher pressures can be generated using an air compressor. The design pressure level of the refuse compression apparatus can thus be set through a wide pressure range, but the compressive forces described above are sufficient for common household refuse. Furthermore, these pressure levels are more desirable in a refuse compression apparatus for primarily household use due to safety considerations and the ability to construct the apparatus more inexpensively because a special pressure-resistant construction is not required.

In addition, if the air pump 8 is reversed after refuse compacting is completed to depressurize the airtight space 13*t*, each of the sub-containers 1*a*, 1*b*, 1*c*,and 1*d* slides down gravitationally and the refuse container 1 will again expand, creating space to hold additional refuse.

It is to be noted that cylindrically shaped members made of metal are used for the telescopic refuse container 1 in the preferred embodiment described above, but any other shape and material having sufficient constructional strength enough to withstand the pressure during the refuse compression operation can be employed.

Figure 2:
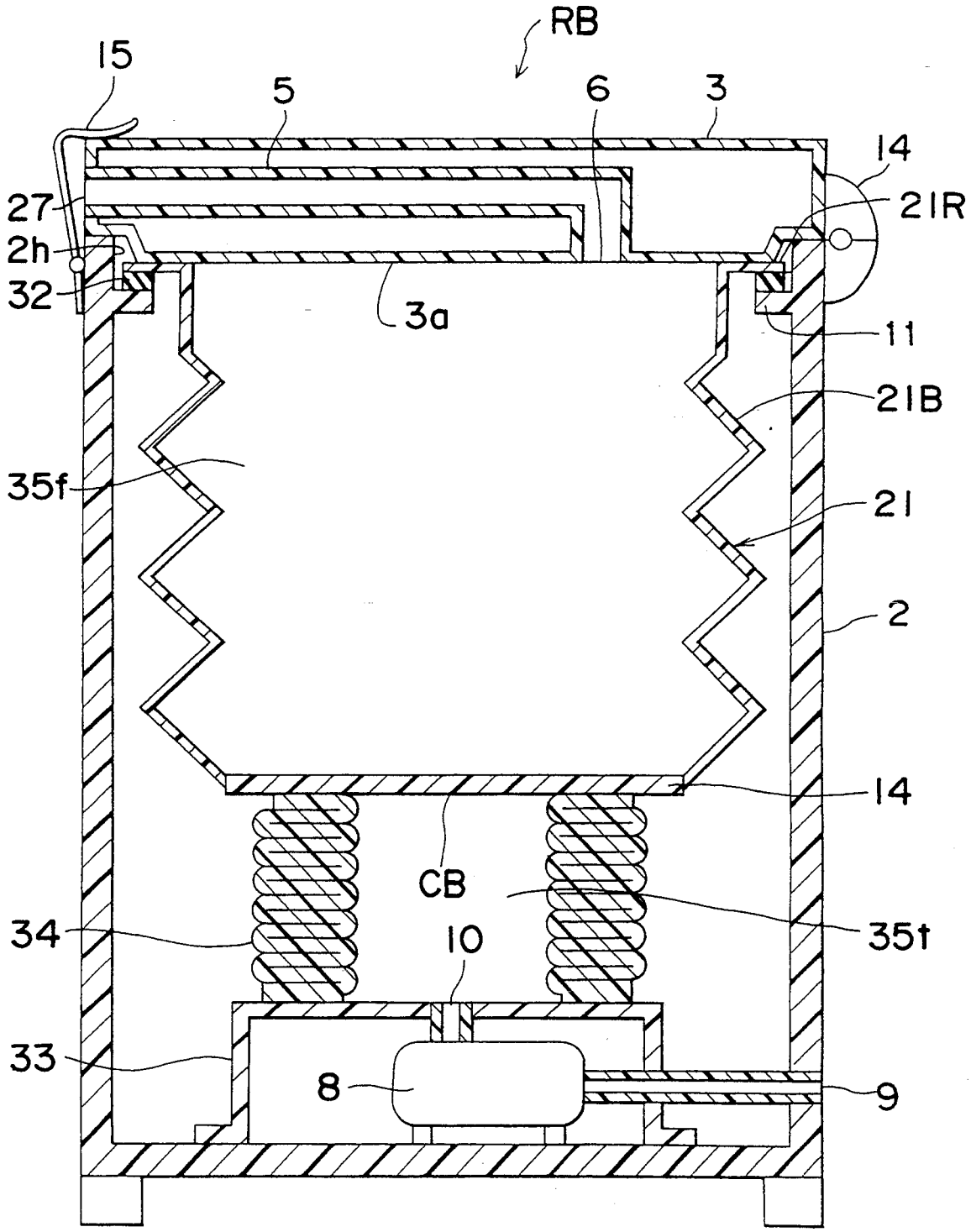
FIG. 2 is a view similar to FIG. 1, but particularly showing a bellows type refuse container according to a modification of the first embodiment of the present invention.

Referring to FIG. 2, a modification of the refuse compression apparatus according to the first embodiment is shown. In this modification, the refuse compression device RB has a construction very similar to that of the first embodiment but includes an accordian-type refuse container 21 instead of the telescopic type refuse container 1. The accordian refuse container 21 is formed in a single unit having a bellows-like compressible/expandable construction with a variable internal volume. The accordian refuse container 21 is formed as a corrugated tubular bag including a flange 21R having a length longer than that of the circular base 11, a corrugated bellows portion 21B and a circular bottom plate CB which are integrally formed to define a container unit. The accordian refuse container 21 is made of a resilient and gas-impermeable material such as plastic but may also be made of a rubber, metal, or other material. A single ring packing 32 is employed which is the same as the ring packing 12 of the first embodiment but is not connected with the bag 4.

As the accordian refuse container 21 is housed within the main housing 2 in the same manner as described above, a space inside the main housing 2 is divided into an airtight space 35*t* and a free space 35*f* by the accordian refuse container 21.

Furthermore, the refuse compression apparatus RB further includes a base 33 provided on the bottom of main housing 2 to cover the air pump 8 and a pair of contractile bellows 34 connected with the bottom plate CB of the accordian refuse container 21 and the top surface of base 33 for pulling down the bottom plate CB so as to expand the refuse container 21. The contractile bellows 34 is made of a plastic material on the base 33, but it may also be made of a rubber or metal material.

In operation, as the air pump 8 is operated, the internal pressure of the airtight space 35*t* becomes greater than that of the free space 35*f* as described above. The internal pressure of the airtight space 35*t* acts on the bottom plate CB to move it up against the pulling force applied by the contractile bellows 34 and to contact with the circular tier 3*a* of the lid 3. Thus, the refuse placed in the accordian refuse container 21 is compressed between the circular tier 3*a* and the bottom plate CB. When the internal pressure of the airtight space 35*t* is depressurized by reversing the pump 8, the contractile bellows 34 pulls down on the accordian refuse container 21 to cause it to expand.

Figure 3:
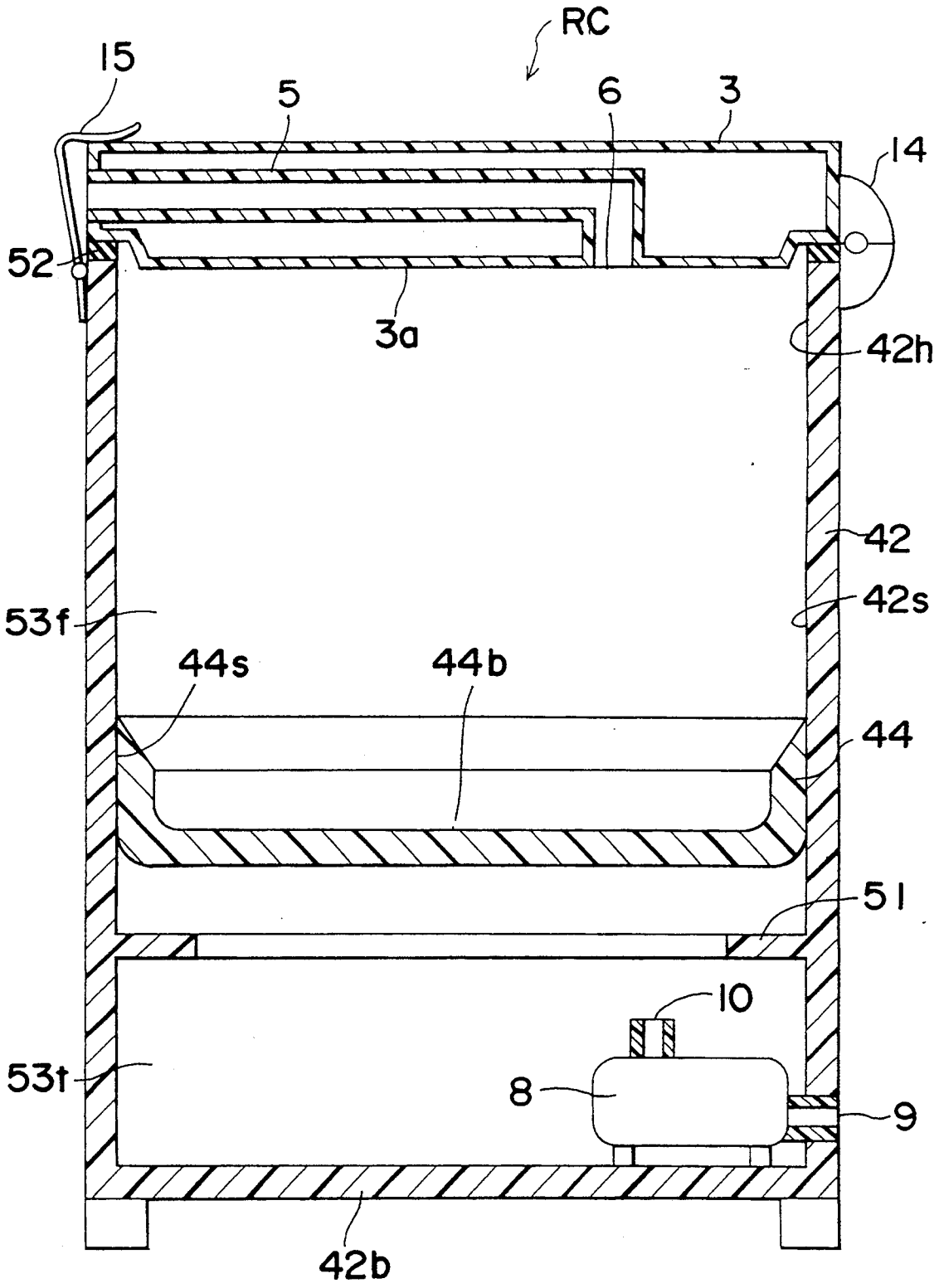
FIG. 3 is a view similar to FIG. 2, but particularly showing an inner plate type refuse container according to another modification of the first embodiment of the present invention.

Referring to FIG. 3, another modification of the refuse compression apparatus according to the first embodiment is shown. In this modification, the refuse compression device RC has a construction similar to that of the refuse compression apparatus RA according to the first embodiment. A main housing 42 includes a bottom plate 42*b* and a circumferential wall 42*s* to define an opening 42*h* at an end of the housing 42 opposing the bottom plate 42 similar to the main housing 2 of the first embodiment. However, the main housing 42 does not include a circular rim such as the circular base 11 near the opening 42*h* end but includes a lower rim 51 which extends around the inner surface thereof with a predetermined thickness to a position above the pump 8 and approximately parallel to the bottom plate 42*b*.

Furthermore, the telescopic refuse container 1 of the first embodiment is replaced by an inner plate 44 formed in a short cylindrical box-like configuration having a bottom plate 44*b* and a cylindrical side wall 44*s* open at one end. The inner plate 44 has the approximately the same configuration as the inner configuration of the main housing 42 so that the inner plate 44 can directly fit in the main housing 42 with its open side up. The inner plate 44 freely slides up and down inside the main housing such that the side wall 44*s* is guided by the inner surface of circumferential wall 42*s* of the main housing 42. By setting the height of the side wall 44*s* at a suitable length, the inner plate 44 can slide smoothly between the lid 3 and the lower rim 51. The lower rim 51 defines the lowest position of the inner plate 44 and the position at which is is normally stationed due to gravity.

In this case, a space inside the main housing 42 is divided into an airtight space 53*t* and a free space 53*f* by the inner plate 44. A ring packing 52 is provided between the opening 42*h* end of the main housing 42 and the lid 3.

In operation, as the air pump 8 is operated, the internal pressure of the airtight space 53*t* becomes greater, causing the inner plate 44 to slide up to compress the refuse placed therein against the circular tier 3*a*. When the internal pressure of the airtight space 53*t* is depressurized by reversing the pump 8, the inner plate 44 gravitates to the original position above the lower rim 51.

It is to be noted that the inner plate 44 is provided with a suitable depth and length of the side wall 44*s*, in this embodiment, but the same function can be achieved by means of a disk or a concave plate with the concavity on the side not in contact with the refuse.

Furthermore, the combinations of refuse containers and compression mechanisms that can be used with a refuse compression apparatus according to the present invention shall not be limited to those described herein, and may include, for example, the refuse container 1 or 44 shown in FIGS. 1 or 3 with the contractile bellows 34 shown in FIG. 2, or the bellows-shaped refuse container 21 of FIG. 2 with the bag 4 shown in FIG. 1.

In addition, a deodorizer may also be placed at an appropriate position in the exhaust passage 5 to remove any odorous gas components that may develop during refuse storage or compacting.

Second Embodiment

Figure 4:
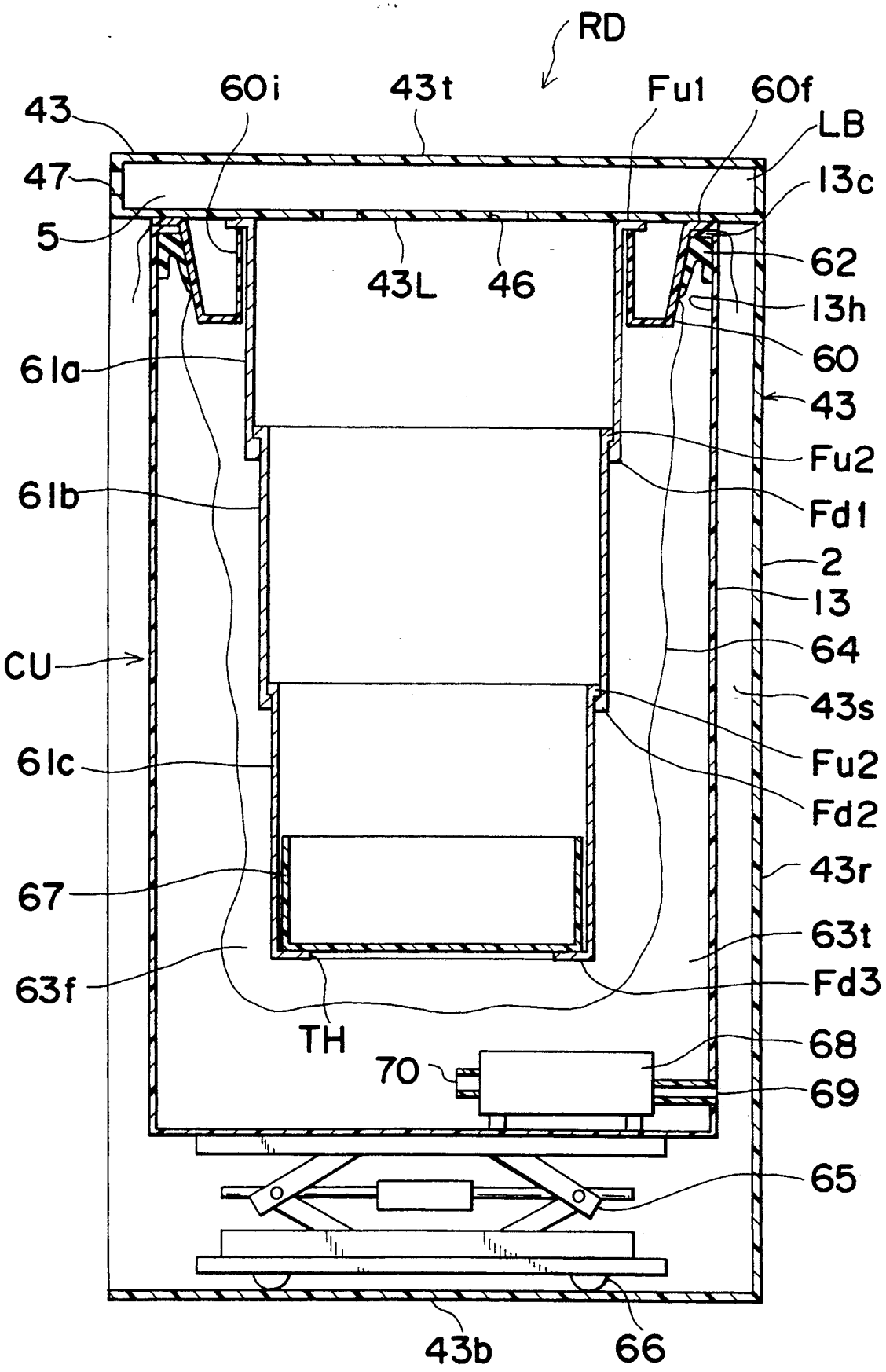
FIG. 4 is a cross-sectional view of a refuse compression apparatus according to a second embodiment of the present invention.

Referring to FIG. 4, a refuse compression apparatus according to a second embodiment of the present invention is shown. In this embodiment, the refuse compression apparatus RD has a construction very similar to the refuse compression apparatus RA of the first embodiment. A main housing 13 in cylindrical form has an opening 13*h* and a circular flange 13*c* radially extending inside at the opening 13*h* end. A circular frame 60 having a U-shaped cross section with the outside surface tapered and an outer flange 60*f* of approximately the same length as that of the circular flange 13*c* is provided.

The circular frame 60 is placed on the main housing 13 with a bag 64 between the outer flange 60*f* and the circular flange 13*c*. Under the circular flange 13*c*, a circular packing 62 is provided to firmly contact with the circular frame 60 in an airtight manner. On the top edge of an inner wall 60*i* of the circular frame 60, a telescopic refuse container 61, formed very similar to the telescopic refuse container 1, is suspended such that a top sub-container 61*a* rests on the inner wall 60*i* and is covered by the bag 64 within the main housing 13. The telescopic refuse container 61 further includes a middle sub-container 61*b* having upper and lower flanges Fu2 and Fd2 and a bottom sub-containers 61*c* having upper and lower flanges Fu3 and Fd3. No bottom plate is provided inside the lower flange Fd3 so that a bottom hole TH is formed.

A bottom tray 67 formed in a cylindrical box-like configuration having a diameter greater than that of the bottom hole TH and a length shorter than those of sub-containers 61*a*, 61*b*, and 61*c* is placed inside the bottom sub-container 61*c* and rested on the lower flange Fd3. Thus, the space inside the main housing 13 is divided into a free space 63*f* and an airtight space 63*t*.

On the bottom of the main housing 13, an air pump 68 is provided with an intake port 69 opening through the side wall of the main housing 13 and an outlet port 70 opening into the airtight space 63*t*. A compression unit CU is thus formed by the main housing 13, ring packing 62, bag 64, circular frame 60, telescopic refuse container 61, and bottom tray 67 and is activated by operating the air pump 68 to increase the inner pressure of the airtight space 63*t*.

In this embodiment, the refuse compression apparatus RD further includes an exterior housing 43 formed in a rectangular box-like configuration defined by a top plate 43*t*, a bottom plate 43*b*, a first side plate 43*s*, a second side plate (not shown) and a third side plate 43*r* so as to have a front opening on the left side, as shown in FIG. 4. Under the top plate 43*t*, a sub plate 43L is integrally connected with the top plate 43*t* so as to form a lid box LB having a box-like structure. Air exhaust inlets 46 and outlets 47 are provided on the lower surface 43L and side surface of the sub-plate 43*t*, respectively, to make an air passage connecting the free space 63*f* to the outside of the refuse compression apparatus RD.

A lifting mechanism 65 with wheels 66 is provided to move the compression unit CU into and out of the exterior housing through the front opening (shown at left in FIG. 4) when the compression unit CU is mounted thereon.

In operation, the compression unit CU mounted on the lifting mechanism 65 with wheels 66 is carried into the exterior housing 43 and located under the sub-plate 43L. The compression unit CU is further lifted up by the lifting mechanism 65 so that the compression unit CU presses against the lower surface of the sub-plate 43L in an airtight manner such that the air exhaust inlets 46 open into the telescopic refuse container 61. In a manner similar to the above described embodiment, as the inner pressure of the airtight space 63*t* is increased by the pump 68, the bag 64 is pressed against the telescopic refuse container 61, causing each of sub-containers 61*c*, 61*b*, and 61*a* to slide up to the upper position defined by the sub plate 43L. When the telescopic refuse container 61 shrinks and reaches the upper position, the bag 64 further presses the bottom tray 67 against the sub-plate 34L through the bottom hole TH so that the refuse placed in the bottom tray 67 is compressed between the bottom tray 67 and the sub plate 43L. It is to be noted that since the compression unit CU is now firmly held between the sub-plate 43L and the bottom plate 43*b*, the air pressure generated by the air pump 68 is effectively used for compressing the refuse. However, if the exterior housing 43 has a sufficient weight to withstand such air pressure, the bottom plate 43*b* can be omitted. As the airtight space 63*t* expands, the air in the free space 63*f* is forced out of the refuse compression apparatus through the air exhaust inlets 46 and outlet 47.

For maximum compression of paper, cans, and other compressible refuse, it is effective to make the height of the bottom tray 67 walls sufficiently low relative to the height of the walls of sub-containers 61*a*, 61*b*, and 61*c*. By setting the height of bottom tray 67 at an optimum value as shown in the figure, the compression rate per single operation with this embodiment is a maximum of approximately 1/7, and refuse can be loaded after compacting to repeat the process numerous times.

Figure 5:
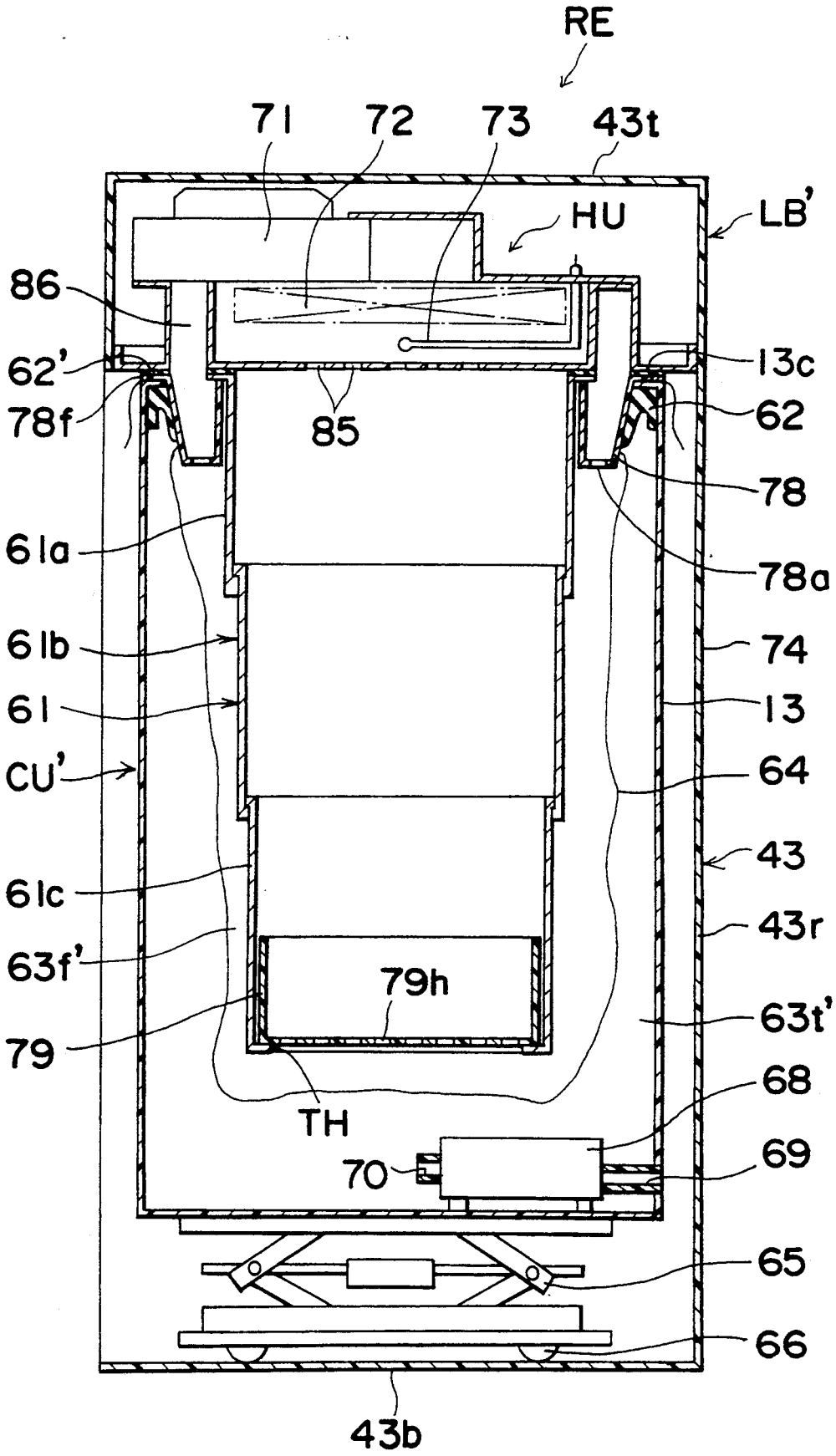
FIG. 5 is a view similar to FIG. 4, but particularly showing an additional hot air generation unit according to a modification of the second embodiment of the present invention.

Referring to FIG. 5, a modification of the refuse compression apparatus according to the second embodiment is shown. In this modification, the refuse compression apparatus RE has a construction similar to that of the refuse compression apparatus RD according to the second embodiment. The most significant difference in the construction of this embodiment is the use of a hot air generating unit HU, incorporated in a lid box LB', formed by an electric heater 72 for heating the air, a fan 71 for moving the heated air to make a heated air stream, a temperature sensor 73 for detecting a temperature of the heated air stream and a control unit CL (not shown) for controlling the operation of the refuse compression apparatus RE. In this embodiment, the lower plate of the lid box LB' is formed of metal, but any other heat resistant material having a mechanical strength sufficient to withstand the pressure applied during the refuse compression may be used. It is to be noted that there is a tendency for bad odors to result from heating the plastic refuse because food remains will typically be left on the plastic refuse. An oxidation catalyst layer is therefore formed on the surface of the electric heater 72 in this modification to provide a deodorization function to clean odor vapors from the circulating hot air so that the released air is odorless.

On the bottom of the lid box LB', a perforated vent portion 85 for allowing the hot air stream to pass is provided in a circular area having a diameter approximately the same as that of the refuse container 61. An air intake 86 is further provided outwardly of the perforated vent portion 85.

In a compression unit CU' of this modification, a circular frame 78 having a construction very similar to the circular frame 60 but having an air hole 78*a* opening through the bottom so as to oppose the air intake 86. A bottom tray 79 has the same construction as that of the bottom tray 67 except the bottom tray 79 has air holes 79*h* provided on the bottom thereof. A flat ring packing 62' is placed between the lid box LB' and the circular frame 78*f*.

In operation, when the lifting mechanism 65 is operated, the compression unit CU' is moved up to couple with the hot air generating unit HU. Electricity is then supplied to the electric heater 72 to raise the temperature of the ambient air and to produce hot air, and the fan 71 is run. The hot air stream is forced through the perforated vents 85 into the refuse container 61, thus heating the plastic refuse contained therein and then passing through the holes 79*h* and TH from the container 61. The exhausted air passes into the air space between the bag 64 and the refuse container 61 is returned to the hot air generating means HU through the air holes 78*a*, and is recirculated to the fan 71 via the air intake 86, thus circulating the hot air inside and outside of the refuse container 61.

Plastic refuse in the refuse container 61 is thus heated to enable more efficient compacting. The temperature of the plastic refuse is controlled by detecting the temperature of the air by means of the temperature detector 73 provided near the perforated vents 85. Plastic refuse can be processed more quickly with a higher heating temperature setting, but the high probability of chloride-containing plastics (e.g., polyvinyl chloride (PVC), polyvinylidene chloride) being processed requires extra care be taken to prevent emission of noxious gases due to thermal decomposition of the plastic. The appropriate temperature is thus 130° C., but the recommended range is 104° C. to 140° C. These temperatures are determined taking into consideration that the largest component of plastic refuse on a volume bases is polystyrene foam, which is used for fresh food trays. Second is polyvinyl chloride products used in small bottles and in tofu (Soy bean curd) and egg containers, polyvinylidene chloride products used in plastic food wrap and airtight coverings for instant or prepared foods, and other chloride plastic products. We found that there is a rapid drop in the elasticity of polystyrene foam products when heated to 104° C., at which point compacting becomes easier, that thermal decomposition of and hydrogen chloride gas emission by chloride plastics begins at approximately 170° C. with PVC products and at approximately 130° C. with polyvinylidene chloride products, and that the concentration of these gases is high enough (approx. 0.5 ppm) for a pungent odor to be smelled at approximately 140° C. It was thus determined that the appropriate heating range for a plastic refuse processing apparatus intended primarily for home use is from 104° C. to 140° C., and the limit range of plastic refuse heating is therefore so specified for the present invention.

When the temperature of the plastic refuse in the refuse container 61 reaches this predetermined temperature range. Air pressure is used for the compression operation of this embodiment because a low pressure setting can generate a high compressive force, and offers relatively greater safety.

When the air pump 68 is started, air from outside the system is drawn in through the air intake 69 and pumped through to the airtight space 63*t'* from the air outlet 70, thus increasing the pressure inside the airtight space 63*t'*. The bag 64 thus begins to contract, raising the bottom of the bottom tray 79 through the bottom hole TH of the bottom sub container 61*c*. The refuse container 61 thus contracts and the internal volume decreases, thereby compacting the plastic refuse contained therein.

Because the increase in temperature significantly reduces the elasticity of the plastic, softening by or even melting the plastic refuse, it is easily compacted by contraction of the refuse container 61, and the volume of the plastic refuse is significantly reduced. This compression operation can be repeated numerous times during the heating process. It is to be noted that heating the plastic will greatly reduce but not eliminate the elasticity of the plastic, and as the pressure is released the remaining elasticity of the plastic can cause it to expand again, greatly reducing the compression rate (height after compression/height before compression). To prevent this it is necessary to cool the plastic before reducing the pressure.

Natural cooling can be used, but the compression time can be reduced by using the fan 71 or a dedicated cooling fan (not shown). By thus cooling the plastic refuse while still pressurized, the refuse is solidified in the compressed state as compression is completed. After refuse processing is completed, the compression unit CU' mounted on the lifting mechanism 65 with wheels 66 can be carried out from the exterior housing 43 for removing the small lump of compacted plastic refuse from the refuse container 61 so it can be thrown away.

It is to be noted that the height of the compacted refuse is limited by the height of the walls of the bottom tray 79 because the refuse container 61 is composed of three cylindrical sub-containers 61*a*, 61*b*, and 61*c* and the bottom tray 79. To increase the compression rate, it is effective to make the height of the bottom tray 79 walls sufficiently low relative to the height of the walls of the sub-containers 61*a*, 61*b*, and 61*c*.

Figure 6:
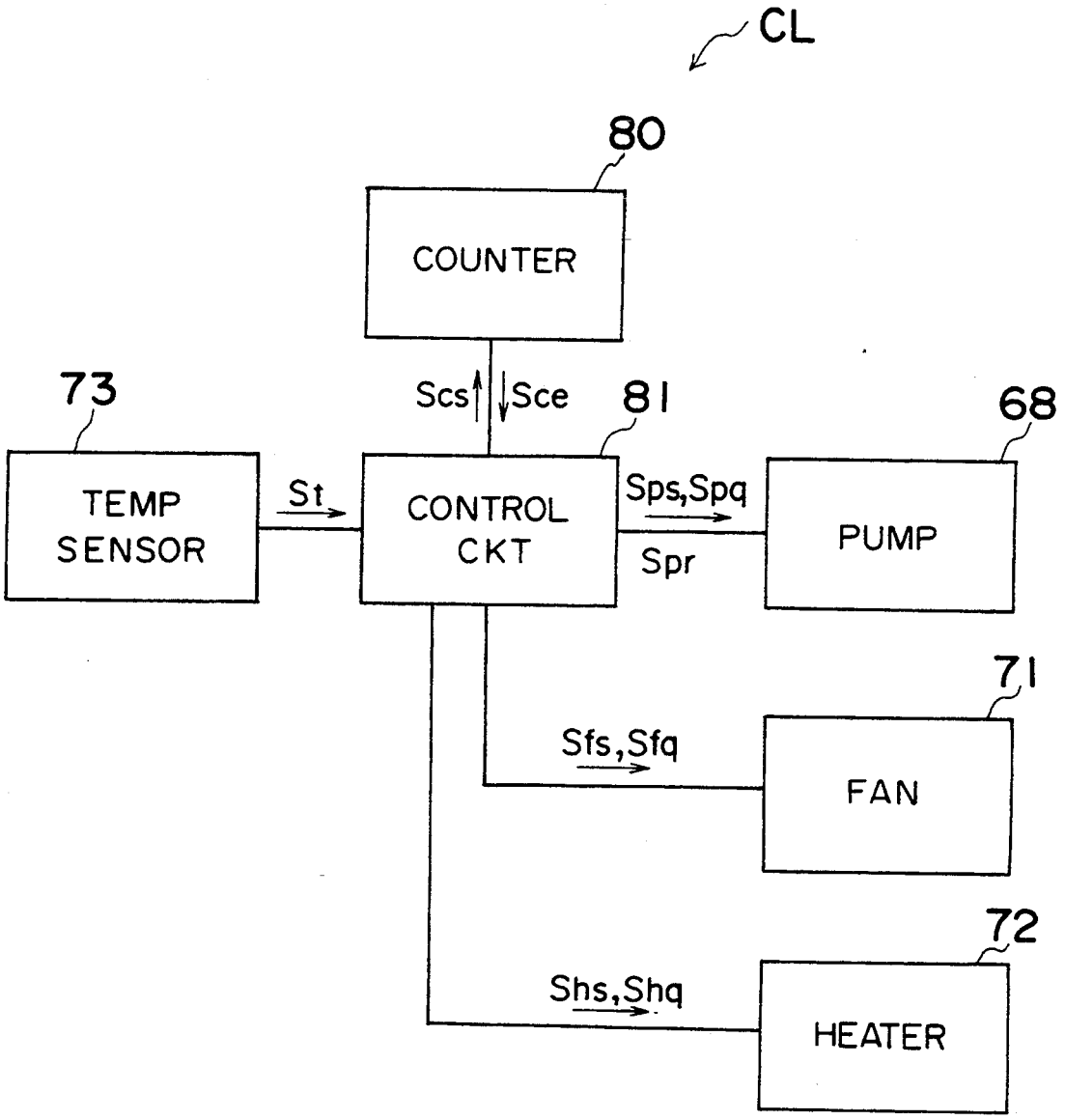
FIG. 6 is a block diagram showing the constitution of a control unit incorporated in the refuse compression apparatus shown in FIG. 5.

Referring to FIG. 6, an example of refuse compression operation by the refuse compression apparatus RE is described. The control unit CL includes the temperature sensor 73 which detects the temperature of the air stream near the perforated vents 85 and produces a temperature signal St based on the detected temperature, the heater 72, the fan 71, the air pump 68, a counter 80 which produces a count signal Sce indicative of the counted number, and a control circuit 81 for controlling the heater 72, the fan 71, the air pump 68, and the counter 80 according to the temperature signal St and count signal Sce.

First, when the control unit CL is operated to turn on the heater 72, the control unit CL produces a fan start signal Sfs for turning on the fan 71 and a heater start signal Shs for turning on the heater 72.

When the detected temperature St reaches the above described predetermined temperature range, the control circuit 81 produces a pump start signal Sps for activating the air pump 68 and a counter start signal Scs for activating the counter 80 to count by number or time. It is to be noted that the temperature of air stream is employed for determination of the refuse's temperature because detection of actual temperature of the refuse is not practical.

On receipt of the pump start signal Sps, the air pump 68 draws the air into the compression unit CU', causing the refuse to be compressed in the above described manner. The control circuit 81 turns ON and OFF the heater 72 according to the temperature signal St so that the detected temperature St is maintained within the predetermined preferable range 104° to 140° C.

When the counter 80 counts up a first predetermined number T1, or a first predetermined period, the control circuit 81 produces a heater stop signal Shq for turning off the heater 72. The first predetermined number T1 is determined in consideration of the time required for the refuse container 61 to slide up and the thermally softened plastic refuse to be compressed completely. Since the fan 71 is still operating, the air stream not heated is circulated to forcibly cool down the heated plastic refuse on the bottom tray 79 as compressed.

When the counter 80 counts up a second predetermined number T2, the control circuit 81 produces a fan stop signal Sfq for turning off the fan 71 and a pump reverse signal Spr for reversing the air pump 68 to depressurize the inside pressure of the airtight space 63*t'* for returning the refuse container 61 to the original position. The second predetermined number T2 is determined in consideration of the time required for the heated plastic refuse to cool down to a temperature at which the compressed plastic cannot expand again.

When the counter 80 counts up a third predetermined number T3, the control circuit 81 produces a pump stop signal Spq for turning off the air pump 68. The third predetermined number T3 is determined in consideration of the time required for the contracted refuse sub-containers 61*a*, 61*b*, and 61*c* to slide down to the original position. It is also possible to set the control circuit 81 to produce the fan stop signal Sfs when the counter 80 counts up the first predetermined number T1 so that the heated plastic refuse will be cooled down naturally.

Since there is no means for exhausting the heated air outward during the refuse compressing operation in this embodiment, the space 63*f'* inside the bag 64 is also confined by the compression unit CU' and the lid box LB' in an airtight manner. However, it is to be noted that the bag 64 can compress the space 63*f'* due to an imbalance of the inner pressures of the airtight space 63*t'* and the space 63*f'*, requiring a higher pressure when compared with the above described embodiments.

Figure 7:
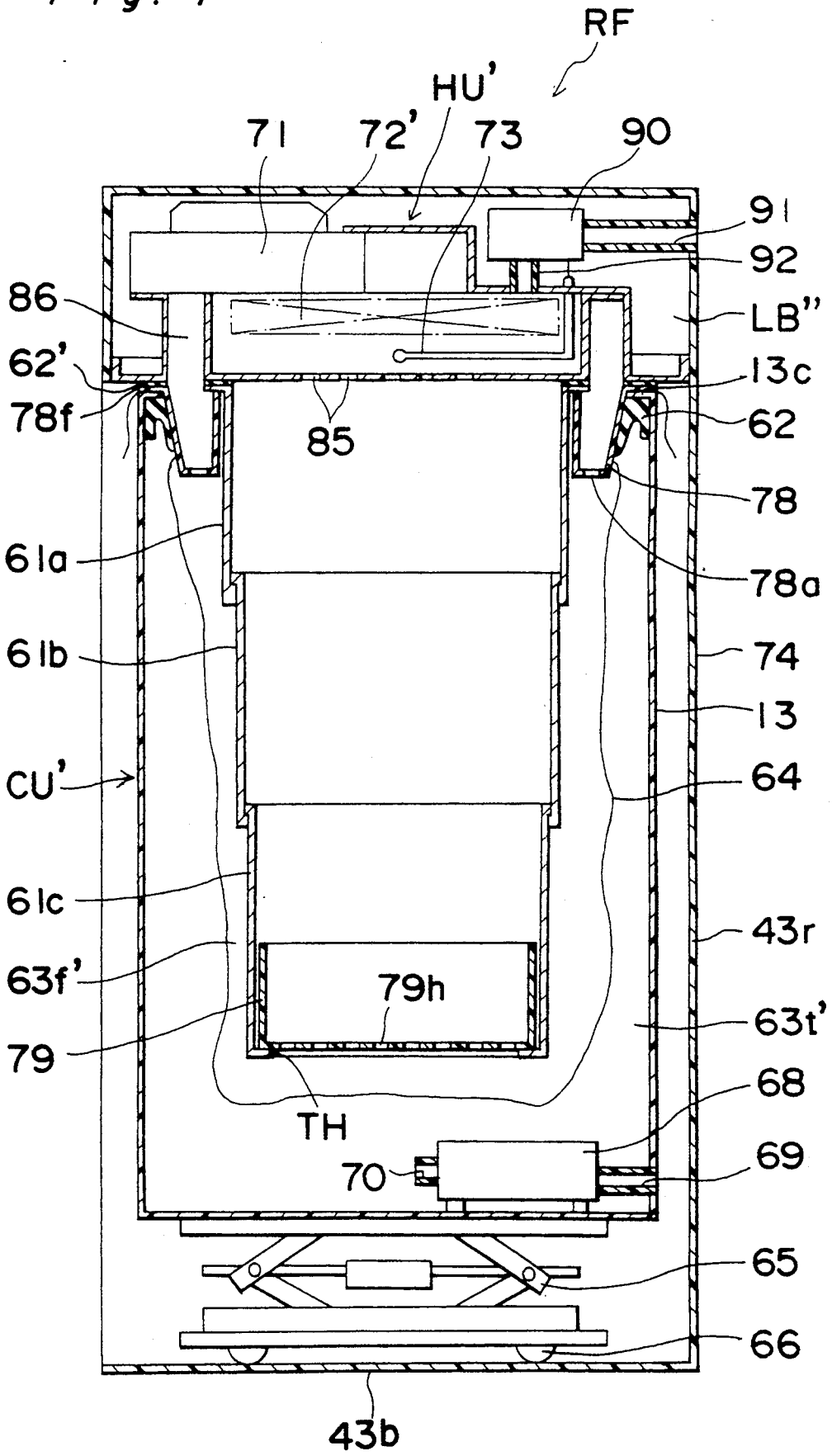
FIG. 7 is a view similar to FIG. 5, but particularly showing an additional exhausting unit according to another modification of the second embodiment of the present invention.

Referring to FIG. 7, another modification of the refuse compression apparatus RF according to the second embodiment is shown. In this modification, the refuse compression apparatus RF has almost the same construction as that of the refuse compression apparatus RE shown in FIG. 5 except that the heater 72 is replaced by a heater 72' having no catalyst layer and an exhaust unit 90 including a catalyst for deodorization is additionally provided on the hot air generating unit HU'. The exhaust unit 90 includes an exhaust inlet 92 at a top of the hot air generation heating unit HU' and an exhaust outlet 91 at the side of the lid box LB'' and exhausts the deodorized heated air from the refuse compression apparatus RF during the compression of the refuse. Thus, the refuse compression apparatus RF can compress the plastic refuse with a lower pressure when compared with the refuse compression apparatus RD and prevents the escape of bad odors.

Furthermore, while the hot air generating unit HU' in this embodiment is secured to the outside of the compression unit CU', and the compression unit CU' is moved when putting refuse into or removing refuse from the compression unit CU', it is also possible to have the compression unit CU' stationary and the hot air generating unit HU' mounted in the lid box LB'' which can be opened and closed.

Furthermore, the refuse compression apparatus according to the present invention is intended primarily as a plastic refuse processing system for private residential use, but its application shall not be so limited and the refuse compression apparatus can be used with equal effectiveness to reduce the volume of plastic refuse in stores, offices, small-scale business operations, and similar sites.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A refuse compression apparatus comprising:

a housing having a first open end and a peripheral edge formed about said first open end;

a bag disposed in said housing so as to divide an interior of said housing into a first space defined inside said bag and a second space defined outside said bag;

a volume changeable container disposed in said first space and being adapted to receive refuse;

a cover device mounted over said first open end of said housing and including a cover surface covering said first open end, said cover surface having at least one air passage formed therethrough in communication with an interior of said volume changeable container;

pressurizing means for increasing ambient pressure in said second space relative to ambient pressure in said first space; and hot air stream generation means for producing a heated air stream and causing the heated air stream to flow into said volume changeable container through said at least one air passage, said hot air stream generation means comprising a heater mounted to said cover device for producing heated air, and a fan operably communicated with said heater and said at least one air passage to blow the heated air through said at least one air passage and into said volume changeable container.

2. A refuse compression apparatus as recited in claim 1, further comprising temperature detection means for detecting a temperature of the heated air heated by said heater; and control means, operably coupled with said temperature detection means, said heater and said pressurizing means, for controlling said heater to maintain the temperature of the heated air in a predetermined temperature range, and for actuating said pressurizing means when the heated air first reaches a predetermined temperature in said predetermined temperature range to increase the ambient pressure in said second space relative to the ambient pressure in said first space.

3. A refuse compression apparatus as recited in claim 2, wherein said control means is further operably coupled with said fan and is operable to actuate said fan when said heater is initially turned on.

4. A refuse compression apparatus as recited in claim 3, further comprising counter means for producing a counter signal representing an elapsed time; and wherein said control means is further operably coupled with said counter means and is operable to start said counter means when the heated air reaches said predetermined temperature, to turn said heater off when said counter means reaches a first predetermined count, and to turn said pressurizing means off when said counter means reaches a second predetermined count which is greater than said first predetermined count.

5. A refuse compression apparatus as recited in claim 4, wherein said control means is further operable to turn said fan off when said counter means reaches a third predetermined count which is between said first and second predetermined counts.

6. A refuse compression apparatus as recited in claim 4, wherein said control means is further operable to actuate said pressurizing means in reverse to reduce the ambient pressure in said second space relative to the ambient pressure in said first space, when said fan is turned off.

7. A refuse compression apparatus as recited in claim 4, wherein said control means is further operable to turn said fan off when said counter means reaches said first predetermined count.

8. A refuse compression apparatus as recited in claim 2, wherein said predetermined temperature range comprises a range of 104° C. to 140° C.

9. A refuse compression apparatus as recited in claim 1, wherein said cover device has an interior portion; and said heater and said fan are mounted in said interior portion of said cover device.

10. A refuse compression apparatus as recited in claim 1, wherein said volume changeable container comprises a plurality of sub-containers telescopically coupled together.

11. A refuse compression apparatus as recited in claim 10, wherein each of said plurality of sub-containers has first and second open ends, a radially outwardly projecting first rim formed about said first open end, and a radially inwardly projecting second rim formed about said second open end;

said plurality of sub-containers comprises first and second sub-containers;

said first rim of said first sub-container is supported on said peripheral edge of said housing, and said first rim of said second sub-container is slidably coupled with said first sub-container; and a bottom tray is supported on said second rim of said second sub-container.

12. A refuse compression apparatus as recited in claim 11, wherein said plurality of sub-containers further comprises a third sub-container interposed between said first and second sub-containers; and said first rim of said third sub-container is slidably engaged in said first sub-container and is engageable with said second rim of said first sub-container, and said first rim of said second sub-container is slidably engaged in said third sub-container and is engageable with said second rim of said third sub-container.

13. A refuse compression apparatus as recited in claim 1, further comprising exhaust means for exhausting heated air from said first space, said exhaust means including a catalyst for deodorizing the heated air as it is being exhausted.

14. A refuse compression apparatus comprising:

a housing having a first open end and a peripheral edge formed about said first open end;

a bag disposed in said housing so as to divide an interior of said housing into a first space defined inside said bag and a second space defined outside said bag;

a volume changeable container disposed in said first space and being adapted to receive refuse;

a cover device mounted over said first open end of said housing and including a cover surface covering said first open end, said cover surface having at least one air passage formed therethrough in communication with an interior of said volume changeable container;

pressurizing means for increasing ambient pressure in said second space relative to ambient pressure in said first space; and wherein said volume changeable container comprises a plurality of sub-containers telescopically coupled together.

15. A refuse compression apparatus as recited in claim 14, wherein each of said plurality of sub-containers has first and second open ends, a radially outwardly projecting first rim formed about said first open end, and a radially inwardly projecting second rim formed about said second open end;

said plurality of sub-containers comprises first and second sub-containers;

said first rim of said first sub-container is supported on said peripheral edge of said housing, and said first rim of said second sub-container is slidably coupled with said first sub-container; and a bottom tray is supported on said second rim of said second sub-container.

16. A refuse compression apparatus as recited in claim 15, wherein said plurality of sub-containers further comprises a third sub-container interposed between said first and second sub-containers; and said first rim of said third sub-container is slidably engaged in said first sub-container and is engageable with said second rim of said first sub-container, and said first rim of said second sub-container is slidably engaged in said third sub-container and is engageable with said second rim of said third sub-container.

17. A refuse compression apparatus comprising:

a housing having a first open end and a peripheral edge formed about said first open end;

a bag disposed in said housing so as to divide an interior of said housing into a first space defined in said bag and a second space defined outside said bag;

a volume changeable container disposed inside said first space and being adapted to receive refuse;

a cover device mounted over said first open end of said housing and including a cover surface covering said first open end, said cover surface having at least one air passage formed therethrough in communication with an interior of said volume changeable container;

pressurizing means for increasing ambient pressure in said second space relative to ambient pressure in said first space;

an exterior housing for receiving said housing, said cover device being fixed to said exterior housing, and said exterior housing having an open side through which said housing can be removed and inserted; and lift means mounted to a bottom end of said housing for supporting said housing, for raising said housing to raise said first open end thereof into contact with said cover device and for lowering said housing away from said cover device.

18. A refuse compression apparatus as recited in claim 17, wherein said lift means comprises wheels for rolling said housing into and out of said exterior housing.

19. A refuse compression apparatus as recited in claim 17, further comprising hot air stream generation means for producing a heated air stream and causing the heated air stream to flow into said volume changeable container through said at least one air passage, said hot air stream generation means comprising a heater mounted to said cover device for producing heated air, and a fan operably communicated with said heater and said at least one air passage to blow the heated air through said at least one air passage and into said volume changeable container.

20. A refuse compression apparatus as recited in claim 19, further comprising temperature detection means for detecting a temperature of the heated air heated by said heater; and control means, operably coupled with said temperature detection means, said heater and said pressurizing means, for selectively turning said heater on and off to maintain the temperature of the heated air in a predetermined temperature range, and for actuating said pressurizing means when the heated air first reaches a predetermined temperature in said predetermined temperature range to increase the ambient pressure in said second space relative to the ambient pressure in said first space.

21. A refuse compression apparatus as recited in claim 17, wherein said volume changeable container comprises a plurality of sub-containers telescopically coupled together.

* * * * *